United States Patent [19]

Kunath

[11] 4,044,878

[45] Aug. 30, 1977

[54] MATRIX PRINTER HEAD HAVING A REMOVABLE ASSEMBLY

[75] Inventor: Helfrid Kunath, Hamburg, Germany

[73] Assignee: U.S. Philips Corporation, New York, N.Y.

[21] Appl. No.: 696,031

[22] Filed: June 14, 1976

[30] Foreign Application Priority Data

June 18, 1975 Germany ..... 2527186

[51] Int. Cl.[2] ..... B41J 3/50

[52] U.S. Cl. ..... 197/1 R; 101/93.05; 346/78

[58] Field of Search ..... 197/1 R; 101/93.04, 101/93.05; 346/78, 79

[56] References Cited

U.S. PATENT DOCUMENTS

| | | | |
|---|---|---|---|
| 3,775,714 | 11/1973 | Heuer | 197/1 R X |
| 3,834,506 | 9/1974 | Priebs | 197/1 R |
| 3,848,719 | 11/1974 | Milan | 197/1 R |
| 3,963,108 | 6/1976 | Steinhausser | 197/1 R |

FOREIGN PATENT DOCUMENTS

| | | | |
|---|---|---|---|
| 2,415,214 | 3/1974 | Germany | 197/1 R |
| 2,359,357 | 11/1973 | Germany | 197/1 R |
| 2,119,415 | 1/1973 | Germany | 197/1 R |
| 646,886 | 9/1937 | Germany | 197/1 R |

*Primary Examiner*—E. H. Eickholt

*Attorney, Agent, or Firm*—Frank R. Trifari; David R. Treacy

[57] ABSTRACT

A matrix printer head having a plurality of mutually parallel, straight printing pins guided within at least two mating, semi-cylindrical rods. The rod outer surfaces guide armatures which are connected to the printing pins.

Components which are subject to wear, such as the printing pins and the armatures, are easily replaced by removing the rods from the housing of the printer.

7 Claims, 8 Drawing Figures

33
93
57
47
75
45
43
71
42
35
79
77
55
83
91
89

MATRIX PRINTER HEAD HAVING A REMOVABLE ASSEMBLY

BACKGROUND OF THE INVENTION

1. Field of the Invention

The invention relates to a matrix printer head comprising a housing accommodating a number of mutually parallel, substantially straight printing pins which are displaceable in their longitudinal direction, the free ends of the pins which are intended for printing being arranged in a straight line. Such printing pins are secured, near their respective ends remote from the printing end, to cylindrical armatures which are slidable parallel to the longitudinal direction of the printing pins and which are coaxially arranged one behind the other.

2. Description of the Prior Art

German Pat. Specification No. 2,015,122, to which U.S. Pat. No. 3,603,442 corresponds, describes a matrix printer head of this kind in which the armature is composed of two parallel, concentric flanges which have an angular shape and which are connected, by way of flexible spokes, to a cylinder which is coaxially arranged relative to the flanges. An electrical coil is wound on the cylinder. To supply power to the electrical coil, the edge of the flanges is clamped in the housing of the matrix printer. The flexible spokes enable displacement of the cylinder relative to the flanges when the coil is excited.

The known matrix printer has a drawback in that the components which are subject to wear, such as the coil and the printing pins, can be replaced only after complete disassembly of the drive section of the printer. This substantially impedes printer maintenance.

SUMMARY OF THE INVENTION

The object of the invention is to provide a matrix printer head in which the printing pins and armatures which are subject to wear can be replaced quickly and easily.

To this end, in a matrix printer according to the invention the armatures are arranged to be slidable on the outer surface of a cylindrical guide which consists of at least two mating, semi-cylindrical rods having a number of adjacently arranged guides for the printing pins.

The armatures, semi-cylindrical rods and printing pins form a removable cylindrical assembly arranged in a bore in the housing concentric with the armatures.

In a preferred embodiment of the invention the armatures are consecutively arranged, and cylindrical fixing rings for the guide rods are located between and constitute an abutment for the armatures, the outer diameters of the armatures and the fixing rings being substantially equal to the diameter of the bore in the housing. As a result of the fact that the fixing rings of the guide rods are also utilized as abutments for the armatures, separate abutments for the armatures can be dispensed with.

In a further preferred embodiment of the invention, the guide for the armatures consists of a single continuous semi-cylindrical rod and a plurality of mating, comparatively short semicylindrical rods.

BRIEF DESCRIPTION OF THE DRAWING

The invention will be described in detail hereinafter with reference to the drawing, in which.

DESCRIPTION OF THE PREFERRED EMBODIMENT

Figure 1:
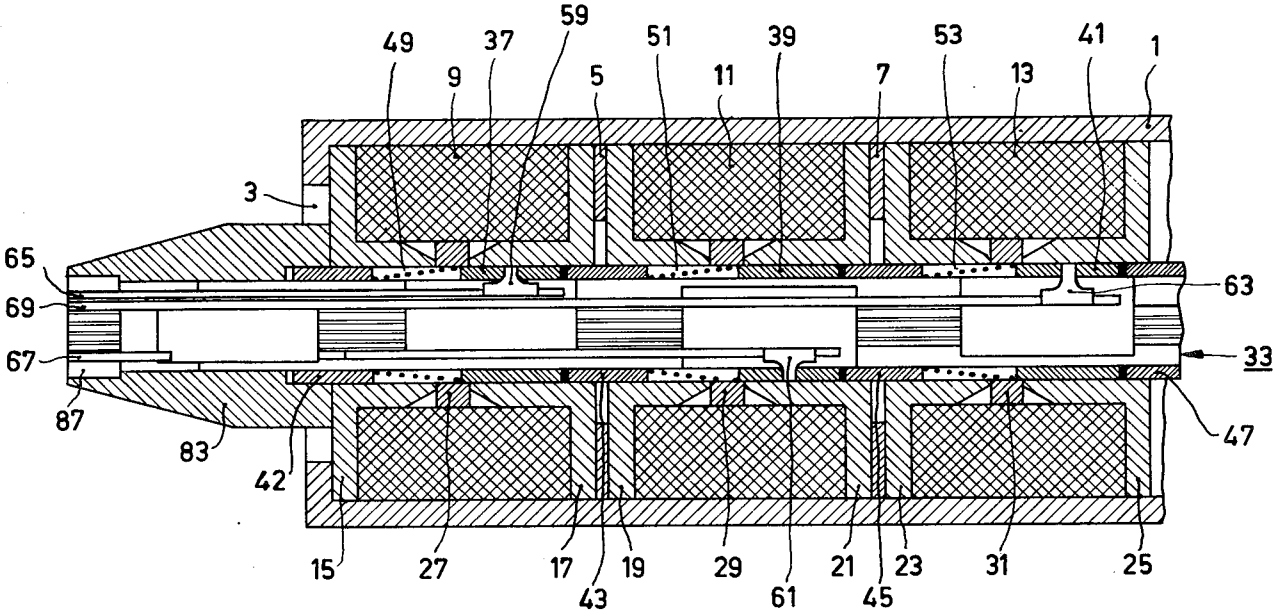
FIG. 1 is a longitudinal sectional view of the printing head of a preferred embodiment in accordance with the invention.

For the sake of simplicity, the figures only show the part of the matrix printer according to the invention in which the invention is embodied, that is to say the printing head. The means for transporting the printing head along a record carrier or for transporting the record carrier along the printing head are of a known and commonly used kind and, consequently, they are not shown. The printing head shown in FIG. 1 comprises a cylindrical housing 1 of magnetically conductive material which is provided with a round aperture 3. The housing 1 is sub-divided into seven compartments by circular rings 5 and 7. Only three of the seven compartments are shown for the sake of simplicity. The compartments, separated by the rings 5 and 7, accommodate electrical excitation coils 9, 11 and 13 which are coaxially arranged, consecutively one behind the other. The coils 9, 11 and 13 are disposed about pairs of pole shoes 15, 17, 19, 21 and 23, 25, respectively. All pole-shoes have a T-shaped cross-section and are made of magnetically conductive material. The pole shoes each comprise a central hollow cylinder to which a circular flange is connected at a remote end. The central cylinders within a pair of pole shoes always face each other, and are magnetically separated by an intermediate ring 27, 29 and 31, respectively. The intermediate rings 27, 29 and 31 are made of a non-magnetic material such as, for example, copper or a suitable synthetic material.

Figures 6A, 6B:
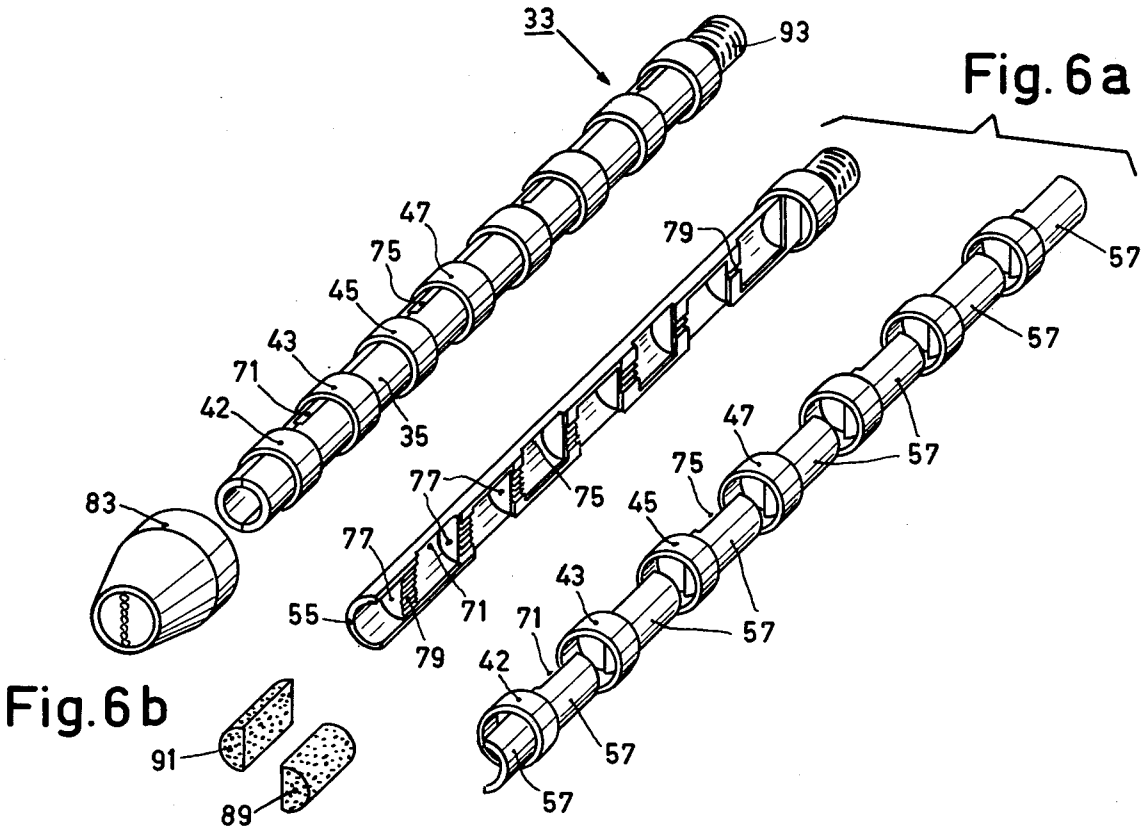

The central hollow space of the pole shoes and intermediate rings, coaxially arranged one behind the other, forms a bore which extends through the entire printing head and in which an assembly 33 (see also the FIGS. 2, 3, 6*a* and 6*b*) is arranged to be axially removable. The assembly 33 is formed mainly by a cylindrical guide 35 about which a number of slidable, tubular armatures 37, 39 and 41 of a magnetically conductive material, and a number of fixing rings 42, 43, 45 and 47 are mounted, in alternating sequence. Helical springs 49, 51 and 53 are arranged between the armatures 37, 39, 41 and the fixing rings 42, 43, 45, respectively. The fixing rings serve to clamp together a semi-cylindrical rod 55 and a number of mating semicylindrical rods 57. The rods 55 and 57 together constitute the guide 35 for the armatures (see FIGS. 3, 6*a* and 6*b*). The fixing rings also serve as abutments for the armatures. One end of each of the helical springs 49, 51 and 53, serving as reset springs, bears against a fixing ring, while its other end bears against a respective armature.

Figure 2:
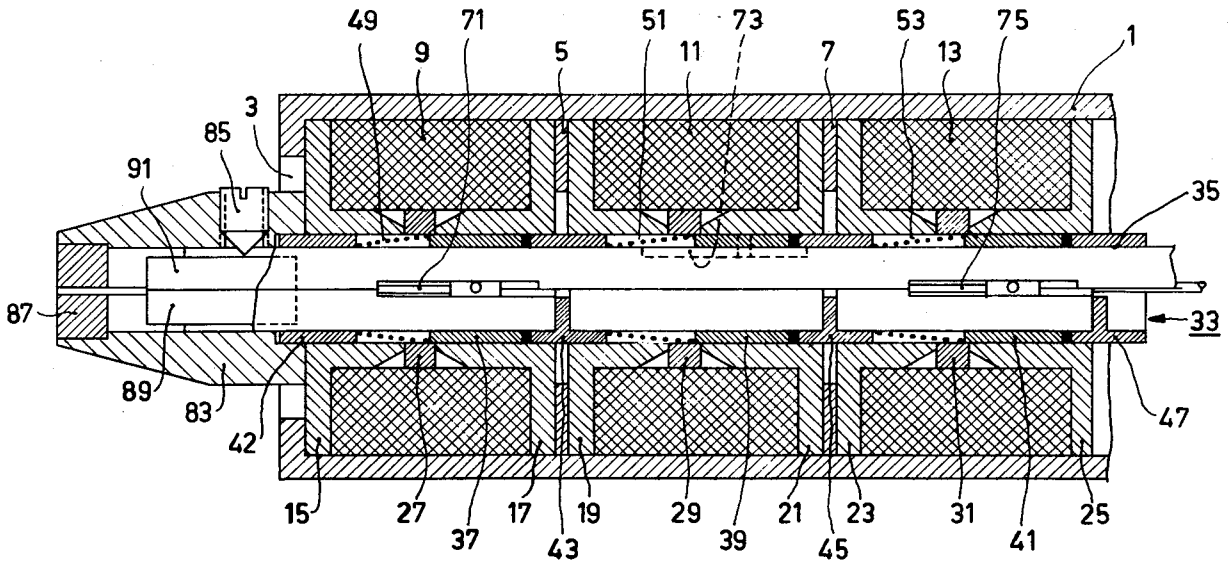
FIG. 2 is a longitudinal sectional view of the printing head of FIG. 1 taken transverse to the FIG. 1 view.

The armatures 37, 39 and 41 are connected, by respective transverse connection pieces 59, 61 and 63, to respective straight, mutually parallel printing pins 65, 67 and 69 which are locally guided within the semi-cylindrical rods 55 and 57. Each transverse connection piece comprises a pin-shaped transverse protruding stem, which engages an aperture in the armature, and a tubular portion which is clamped about the printing pin. However, it is alternatively possible to solder or weld the transverse connection piece to the armature and the printing pin. As is shown in FIG. 2, the rod 55 and the rods 57 comprise connecting recesses which form slots 71, 73 and 75 for the slidable transverse connection pieces between armature and printing pins.

As has already been stated, the housing 1 is divided into seven compartments. These compartments are identical and each compartment contains a coil for driving an associated armature and printing pin. Thus, the matrix printer comprises seven straight printing pins which are mutually parallel and whose ends which are intended for printing are situated in a straight line. Each character printed by means of the matrix printer is composed of a selection from a matrix of thirty-five points. The matrix from which the selection of points is made can be modified by using a matrix printer in accordance with the invention which comprises a larger or smaller number of printing pins.

The semi-cylindrical rods 55 and 57 (see FIG. 6*a*) of the assembly 33 accommodate seven bridge pieces 77 (only three pieces are denoted by references) in which semi-cylindrical guide grooves 79 for the printing pins are situated. The guide grooves of the rod 55 and the comparatively short rods 57 mate. The guide grooves in the short rods 57 which are not visible in the drawing (FIG. 6*a*) are identical to the oppositely situated grooves in the long rod 55. The slots 71, 73 and 75 for the transverse connection pieces between armatures and printing pins are alternately situated a plane through the rod axis (see FIGS. 2, 6*a* and 6*b*). This is repeated for the four other slots which are not denoted by references.

The described preferred embodiment of the matrix printer comprises a guide 35 which is mainly composed of a continuous rod 55 and seven short rods 57. A construction of this kind offers the advantage that the assembly and disassembly of the guide 35 itself are extremely simple. However, a quickly extractable assembly 33 can very well be obtained by composing the guide 35 from two identical long continuous rods 55 and 57. In that case a long, continuous slot 81 (see FIG. 4) in which all seven transverse connection pieces between armatures and printing pins are guided to be slidable is then formed at the interface between the two semi-cylindrical long rods. The slot 81 should extend as far as or slightly beyond the neutral position of the rearmost transverse connection piece (at the extreme right in the drawing) between armature and printing pin. The slot 81 is preferably chosen to be a length shorter than the overall length of the rods 55 and 57 in order to obtain bearing faces. However, it is alternatively possible to make the slot 81 continuous and to insert dowel pins at the front and the rear of the guide 35 to provide the necessary bearing face.

Figure 3:
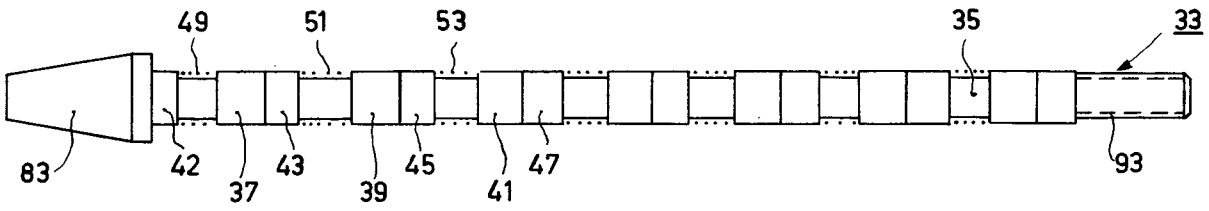
FIG. 3 is a longitudinal elevation of the removable assembly used in the matrix printer shown in the FIGS. 1 and 2.
Figure 5:
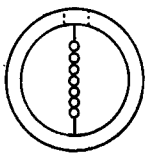
FIG. 5 is an end view of the assembly shown in FIG. 4, FIGS. 6*a* and 6*b* are perspective exploded views of the assembly shown in FIG. 3.

The assembly 33 is assembled completely outside the housing 1 which has already been provided with pole shoes, magnetically insulating rings and electrical coils. The assembly is preferably started by mounting the longest printing pin, including the armature, on the long rod 55 after the extreme right fixing ring has been slid onto the rod 55. Subsequently, the extreme right short rod 57 is provided, followed by the reset spring and the next fixing ring. Proceding from the right to the left, all fixing rings, printing pins, armatures and reset springs are successively mounted, after which a conical nose 83 is secured on the guide 35 by means of a screw 85. The nose 83 is mounted against the end face of the fixing ring 42. The nose 83 accommodates a bearing 83 for the front portion of the printing pins. The nose 87 furthermore comprises two felt shells 89 and 91 which grip about the printing pins and which contain a lubricant (see FIG. 2). The assembled unit thus obtained can be simply slid into the central, continuous bore in the housing 1. The nose 83 can be secured to the housing 1 in any known manner, which is not shown. Alternatively, the rods 55 and 57 can be provided with a thread 93 near their right end for securing in the housing 1 (FIG. 3). After wear or fracture of the printing pins, the unit assembly can be quickly and simply replaced by a new unit. The preferred embodiment of the printer comprising the short rods 57 offers a further advantage in that, should one of the shortest printing pins break, the assembly 33 must be disassembled only partly, provided that the wear of the other printing pins is still within acceptable limits.

Instead of a round cross section, the printing pins can also have a rectangular cross section. The pins may be provided with elongate eyelets 95 (see FIG. 7) in which projections 97 of the transverse connection pieces with the armature are secured, for example, by soldering or welding.

Figure 4:
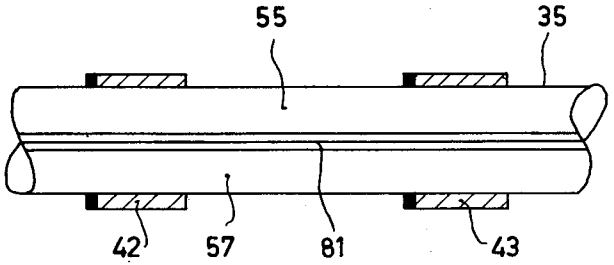
FIG. 4 is an enlarged longitudinal elevation partly in section of an alternative embodiment for the assembly shown in FIGS. 3, 6*a* and 6*b*.
Figure 7:
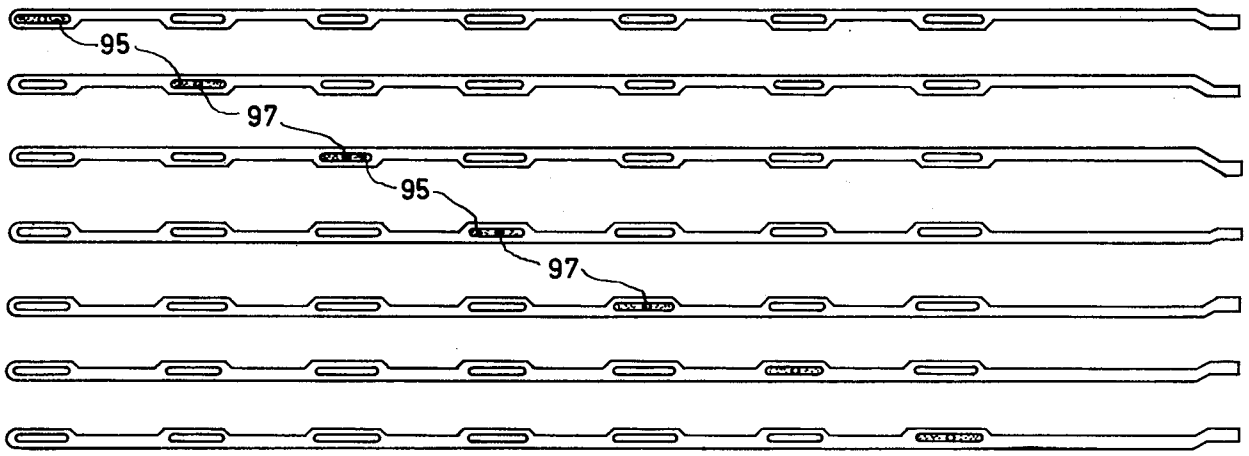
FIG. 7 is a diagrammatic front view of the printing pins for use in a matrix printer in accordance with the FIG. 4 embodiment of the invention.

In the embodiment shown in FIG. 7, the printing pins have the same length. In order to prevent the transverse connection pieces 97 from coming into conflict with the pins, the pins each have seven eyelets. The length of these eyelets equals at least twice the stroke of the armatures, because the transverse connection pieces are always secured in the center of the respective eyelet. Thus, the eyelets of a printing pin which are not intended for the connection of a transverse connection piece allow unimpeded passage of the transverse connection pieces of the other printing pins. The eyelets of the printing pins can be guided in suitable grooves in the rod 55 of the guide 35, while the remaining part of the pin bodies is guided in bearing grooves of a rectangular section which are provided in the rod 57. The slots in the rods 55 and 57 for guiding the transverse connection pieces are of the continuous type as shown in FIG. 4.

Even though the invention has been described with reference to a matrix printer in which the coil, armature system is of the electromagnetic type, the invention can also be applied for printers comprising a so-called electro-dynamic coil/armature system. The latter system is used inter alia in the known printer described in the preamble. Because the armatures are then constructed as slidable electrical coils, the power must be provided by sliding contacts or by way of an electrical connection, provided inside the guide 35 and comprising flexible connections to the armatures, so that the advantage of ease of replacement of the assembly 33 is maintained.

What is claimed is:

1. A matrix printer head comprising a housing, a plurality of substantially straight printing pins having free ends for printing, means for mounting and guiding said pins in said housing so that said pins are mutually parallel and displaceable in their longitudinal direction, said free ends being arranged in a line, and magnetic means for displacing respective pins, wherein said head has a cylindrical bore extending in said longitudinal direction through said housing, and an axially removable assembly arranged in said bore, said pins and said mounting and guiding means forming part of said assembly; and said assembly comprises a cylindrical guide formed by at least two mating semi-cylindrical rods, said guide having a corresponding plurality of longitudinally extending adjacent guide means for said printing pins; means for retaining the assembly in the bore; a corresponding plurality of armatures forming part of said means for displacing, respectively slidably mounted at longitudinally separated locations on an outer surface of said cylindrical guide for displacement in said longitudinal direction, concentric with said bore; and means connecting individual printing pins to respective armatures for longitudinal displacement therewith.

2. A printer head as claimed in claim 1 wherein said armatures are hollow cylinders having an outer diameter; and said assembly comprises a number of fixing rings arranged respectively between adjacent ones of said plurality of armatures for abutment by said armatures, outer diameters of the armatures and the fixing rings being substantially equal to the diameter of said cylindrical bore.

3. A printer head as claimed in claim 2 wherein said cylindrical guide comprises a single, continuous semi-cylindrical rod and a plurality of mating, comparatively short semi-cylindrical rods, individual ones of said comparatively short rods being fixed in place by a respective one of said fixing rings.

4. A printer head as claimed in claim 3 wherein said continuous guide rod and said comparatively short guide rods each have connecting, mating recesses, and said connecting means comprises a corresponding plurality of members, each member being guided in a respective recess for connection between an armature and a printing pin.

5. A printer head as claimed in claim 3 wherein said adjacent guide means includes a plurality of axially extending mating grooves in said single rod and said plurality of comparatively short rods.

6. A printer head as claimed in claim 1, wherein said housing is sub-divided into a corresponding plurality of longitudinally spaced compartments, said magnetic means comprises a corresponding plurality of electrical excitation coils arranged in respective compartments, and said armatures comprise a magnetically conductive material and are arranged to be displaceable as a result of electrical current flow through respective coils.

7. A printer head as claimed in claim 6 wherein said bore has a wall formed by a stack of pole pieces made of magnetically conductive material, arranged as pairs of pole pieces; of non-magnetic material separating the pole pieces of each pair respectively, said electrical coils being placed about respective pairs of said pole pieces.

* * * * *